US005997127A

United States Patent [19]

Fassler et al.

[11] Patent Number: 5,997,127

[45] Date of Patent: Dec. 7, 1999

[54] ADJUSTABLE VANE USED IN CLEANING ORIFICES IN INKJET PRINTING APPARATUS

[75] Inventors: Werner Fassler; John E. Mooney, both of Rochester; Marcello D. Fiscella, Fairport, all of N.Y.

[73] Assignee: Eastman Kodak Company, Rochester, N.Y.

[21] Appl. No.: 09/159,979

[22] Filed: Sep. 24, 1998

[51] Int. Cl.[6] ..... B41J 2/165

[52] U.S. Cl. ..... 347/28; 347/29

[58] Field of Search ..... 347/28, 21, 22, 347/25, 27, 29

[56] References Cited

U.S. PATENT DOCUMENTS

| | | | |
|---|---|---|---|
| 3,373,437 | 3/1968 | Sweet et al. . | |
| 3,416,153 | 12/1968 | Hertz et al. . | |
| 3,705,043 | 12/1972 | Zabiak . | |
| 3,776,642 | 12/1973 | Anson et al. . | |
| 3,846,141 | 11/1974 | Ostergren et al. . | |
| 3,870,528 | 3/1975 | Edds et al. . | |
| 3,878,519 | 4/1975 | Eaton . | |
| 3,889,269 | 6/1975 | Meyer et al. . | |
| 3,903,034 | 9/1975 | Zabiak et al. . | |
| 4,346,387 | 8/1982 | Hertz . | |
| 5,305,015 | 4/1994 | Schantz et al. . | |
| 5,350,616 | 9/1994 | Pan et al. . | |
| 5,412,411 | 5/1995 | Anderson | 347/28 |
| 5,426,458 | 6/1995 | Wenzel et al. . | |
| 5,431,722 | 7/1995 | Yamashita et al. . | |
| 5,725,647 | 3/1998 | Carlson et al. . | |
| 5,738,716 | 4/1998 | Santilli et al. . | |

*Primary Examiner*—N. Le
*Assistant Examiner*—Shih-Wen Hsieh
*Attorney, Agent, or Firm*—Walter S. Stevens

[57] ABSTRACT

An inkjet printer having an inkjet head and defining a structure having means including a structure defining a plurality of orifices for ejecting ink droplets. A cleaning cavity is spaced from the printing position for receiving cleaning fluid. An adjustable vane partially submerged in the cleaning fluid and spaced from the structure and a pump delivers the cleaning liquid at a desired velocity towards the adjustable vane so that the vane creates a flow of cleaning liquid past the structure in the cleaning cavity space. The adjustable vane is positioned so as to create a desired flow of cleaning liquid which engages the structure.

1 Claim, 6 Drawing Sheets

Fig. 1
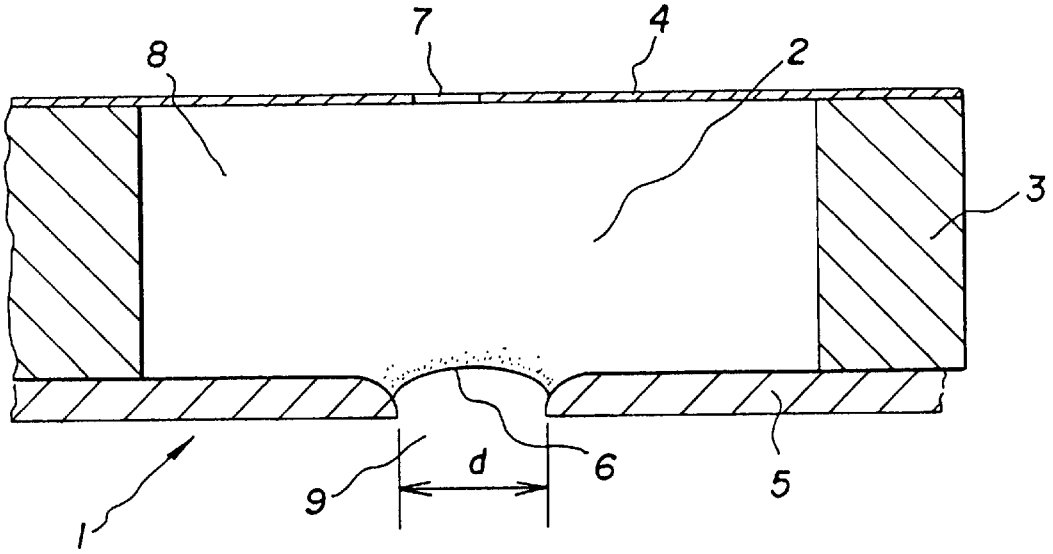
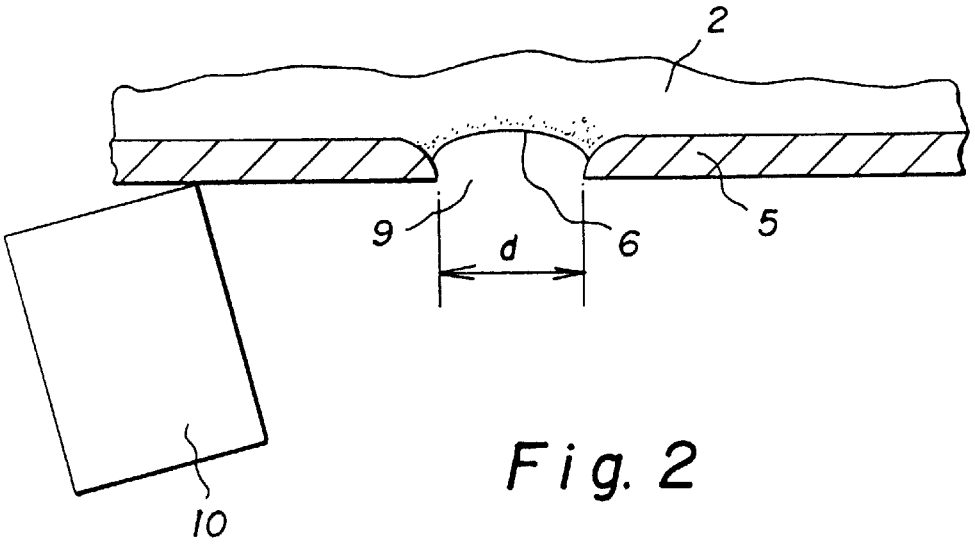
Fig. 2

Fig. 3
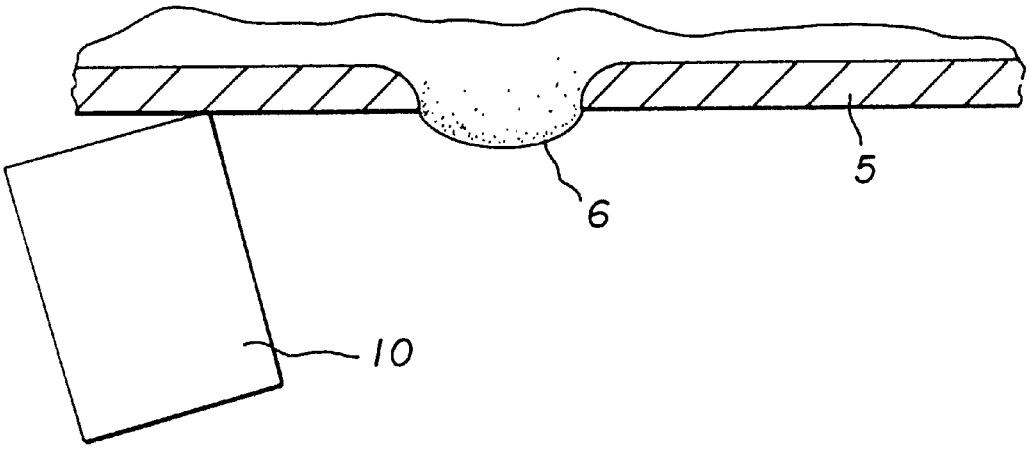
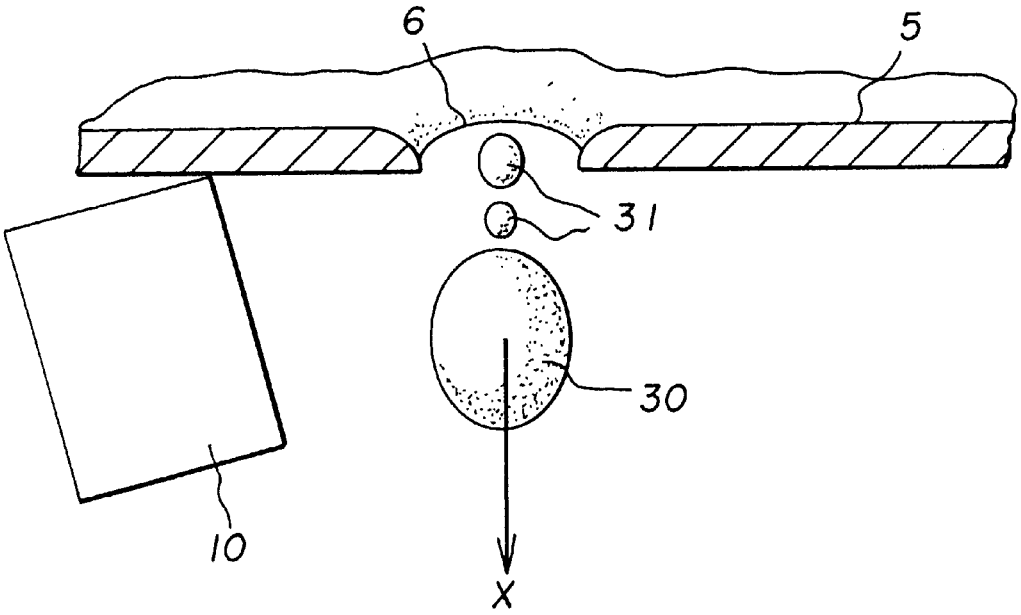
Fig. 4

ADJUSTABLE VANE USED IN CLEANING ORIFICES IN INKJET PRINTING APPARATUS

CROSS REFERENCE TO RELATED APPLICATIONS

Reference is made to commonly assigned U.S. patent application Ser. No. 09/159,447 filed concurrently herewith entitled "Cleaning Orifices in Inkjet Printing Apparatus" to Werner Fassler et al, the disclosure of which is incorporated herein by reference.

FIELD OF THE INVENTION

This invention relates to the cleaning of inkjet print head apparatus having multiple orifices.

BACKGROUND OF THE INVENTION

Many different types of digitally controlled printing systems of inkjet printing apparatus are presently being used. These inkjet printers use a variety of actuation mechanisms, a variety of marking materials, and a variety of recording media. For home applications, digital inkjet printing apparatus is the printing system of choice because low hardware cost make the printer affordable to everyone. Another application for digital inkjet printing uses large format printers. It is a further requirement that these large format printers provide low cost copies with an ever improving quality. Inkjet printing technology is the first choice in today's art. Thus, there is a need for improved ways to make digitally controlled graphic arts media, such as billboards, large displays, and home photos for example, so that quality color images may be made at a high-speed and low cost, using standard or special paper.

Inkjet printing has become recognized as a prominent contender in the digitally controlled, electronic printing arena because of its nonimpact, low-noise characteristics, its use of papers from plain paper to specialized high gloss papers and its avoidance of toner transfers and fixing. Inkjet printing mechanisms can be categorized as either continuous inkjet or droplet on demand inkjet. Continuous inkjet printing dates back to at least 1929. See U.S. Pat. No. 1,941,001 to Hansell.

U.S. Pat. No. 3,373,437, issued to Sweet et al. in 1967, discloses an array of continuous inkjet orifices wherein ink droplets to be printed are selectively charged and deflected towards the recording medium. This technique is known as binary deflection continuous inkjet, and is used by several manufacturers, including Elmjet and Scitex.

U.S. Pat. No. 3,416,153, issued to Hertz et al. in 1966, discloses a method of achieving variable optical density of printed spots in continuous inkjet printing using the electrostatic dispersion of a charged droplet stream to modulate the number of droplets which pass through a small orifice. This technique is used in inkjet printers manufactured by Iris.

U.S. Pat. No. 3,878,519, h issued to Eaton in 1974, discloses a method and apparatus for synchronizing droplet formation in a liquid stream using electrostatic deflection by a charging tunnel and deflection plates.

U.S. Pat. No. 4,346,387, issued to Hertz in 1982 discloses a method and apparatus for controlling the electric charge on droplets formed by the breaking up of a pressurized liquid stream at a droplet formation point located within the electric field having an electric potential gradient. Droplet formation is effected at a point in the field corresponding to the desired predetermined charge to be placed on the droplets at the point of their formation. In addition to charging tunnels, deflection plates are used to actually deflect droplets.

Conventional continuous inkjet utilizes electrostatic charging tunnels that are placed close to the point where the droplets are formed in a stream. In this manner individual droplets may be charged. The charged droplets may be deflected downstream by the presence of deflector plates that have a large potential difference between them. A gutter (sometimes referred to as a "catcher") may be used to intercept the charged droplets, while the uncharged droplets are free to strike the recording medium. If there is no electric field present or if the break off point from the droplet is sufficiently far from the electric field (even if a portion of the stream before droplets break off is in the presence of an electric field), then charging will not occur.

The on demand type inkjet printers are covered by hundreds of patents and describe two techniques for droplet formation. At every orifice, (about 30 to 200 are used for a consumer type printer) a pressurization actuator is used to produce the inkjet droplet. The two types of actuators are heat and piezo materials. The heater at a convenient location heats ink and a quantity will phase change into a gaseous steam bubble and raise the internal ink pressure sufficiently for an ink droplet to be expelled to a suitable receiver. The piezo ink actuator incorporates a piezo material. It is said to possess piezo electric properties if an electric charge is produced when a mechanical stress is applied. This is commonly referred to as the "generator effect". "The converse also holds true; an applied electric field will produce a mechanical stress in the material. This is commonly referred to as the "motor effect". Some naturally occurring materials possessing this characteristics are: quartz and tourmaline. Some artificially produced piezoelectric crystals are: Rochelle salt, ammonium dihydrogen phosphate (ADP) and lithium sulphate (LH). The class of materials used for piezo actuators in an inkjet print head possessing those properties includes polarized piezoelectric ceramics. They are typically referred to as ferroelectric materials. In contrast to the naturally occurring piezoelectric crystals, ferroelectric ceramics are of the "polycrystalline" structure. The most commonly produced piezoelectric ceramics are: lead zirconate titanate, barium titanate, lead titanate, and lead metaniobate. For the inkjet print head a ferroelectric ceramic is machined to produce ink chambers. The chamber is water proofed by gold plating and becomes a conductor to apply the charge and cause the piezo "motor effect". This "motor effect" causes the ink cavity to shrink, raise the internal pressure, and generate an ink droplet.

Inks for high speed jet droplet printers must have a number of special characteristics. Typically, water-based inks have been used because of their conductivity and viscosity range. Thus, for use in a jet droplet printer the ink must be electrically conductive, having a resistivity below about 5000 ohm-cm and preferably below about 500 ohm-cm. For good flow through small orifices water-based inks generally have a viscosity in the range between about 1 to 15 centipoise at 25 degree C.

Over and above this, the ink must be stable over a long period of time, compatible with the materials comprising the orifice plate and ink manifold, free of living organisms, and functional after printing. The required functional characteristics after printing are: smear resistance after printing, fast drying on paper, and waterproof when dry. Examples of different types of water-based jet droplet printing inks are found in U.S. Pat. Nos. 3,903,034; 3,889,269; 3,870,528; 3,846,141; 3,776,642; and 3,705,043.

The ink also has to incorporate a nondrying characteristic in the jet cavity so that the drying of ink in the cavity is hindered or slowed to such a degree that through occasional spitting of ink droplets the cavities can be kept open. The addition of glycol will facilitate the free flow of ink through the inkjet. Inkjet printing apparatus typically includes an inkjet print head that is exposed to the various environment where inkjet printing is utilized. The orifices are exposed to all kinds of air born particles. Particulate debris accumulates on the surfaces, forming around the orifices. The ink will combine with such particulate debris to form an interference burr to block the orifice or cause through an altered surface wetting to inhibit a proper formation of the ink droplet. That particulate debris has to be cleaned from the orifice to restore proper droplet formation. This cleaning commonly is achieved by wiping, spraying, vacuum suction, and/or spitting of ink through the orifice. The wiping is the most common application.

Inks used in inkjet printers can be said to have the following problems:

1) they require a large amount of energy to dry after printing;
2) large printed areas on paper usually cockle because of the amount of water present;
3) the printed images are sensitive to wet and dry rub;
4) the compositions of the ink usually require an antibacterial preservative to minimize the growth of bacteria in the ink;
5) the inks tend to dry out in and around the orifices resulting in clogging;
6) the wiping of the orifice plate causes wear on plate and wiper;
7) the wiper itself generates particles that clog the orifice;
8) cleaning cycles are time consuming and slow the productivity of inkjet printers. It is especially of concern in large format printers where frequent cleaning cycles interrupt the printing of an image; and
9) when a special printing pattern is initiated to compensate for plugged or badly performing orifices, the printing rate declines.

Some of these problems may be overcome by the use of polar, conductive organic solvent based ink formulations. However, the use of non-polar organic solvents is generally precluded by their lack of electrical conductivity. The addition of solvent soluble salts can make such inks conductive, but such salts are often toxic, corrosive, and unstable.

SUMMARY OF THE INVENTION

It is an object of the invention to provide an inkjet printing apparatus wherein cleaning can be effectively accomplished with a minimum number of parts and operations.

It is another object of this invention to provide for cleaning of inkjet printing apparatus orifices which is accomplished in a minimum time cycle.

It is a further object of the present invention to provide for cleaning a particulate debris thereby eliminating the need of traditional wiper blades.

These objects are achieved by an inkjet printer having an inkjet head and defining a structure having means including a structure defining a plurality of orifices for ejecting ink droplets, comprising:

a) means defining an ink cleaning cavity spaced from the printing position for receiving cleaning fluid;
b) an adjustable vane partially submerged in the cleaning fluid and spaced from the structure; and
c) pumping means for delivering the cleaning liquid at a desired velocity towards the adjustable vane so that the vane creates a flow of cleaning liquid past the structure in the cleaning cavity space; and
d) means for positioning the vane so as to create a desired flow of cleaning liquid which engages the structure such that the orifices are cleaned by the cleaning liquid.

ADVANTAGES OF THE INVENTION

Rapid cleaning of orifices in accordance with the present invention can be accomplished in such a short time because of the efficiency of cleaning apparatus in accordance with the present invention.

The cleaning liquid which is pumped over the surfaces of the adjustable vane is filtered, replenished at a predetermined rate and removes waste ink and particulate debris permanently from the inkjet print head.

Another advantage of this invention is that the cleaning liquid flowing over the adjustable vane can have a substantial thickness thereby minimizing the requirements for mechanical tolerances.

Another advantage of this cleaning technique is that with no mechanical rubbing, the wear of the delicate orifice plate is eliminated or greatly reduced. The replacement of the inkjet head will be less frequent and more of the orifices will stay functional to result in a higher image quality.

Another advantage is that individual inks can be cleaned by selecting the pumping rate of fluid and angle of vane to change the laminar flow, and speed rate. In this way, the speed, quantity and direction of the fluid can be selected to match the cleaning needs of a particular ink. In other words, red, green, and blue inks in the same cartridge can have different roller speeds.

BRIEF DESCRIPTION OF THE DRAWINGS

FIG. 1 is a prior art cross sectional schematic view of a typical piezo electric inkjet print head;

FIG. 2 is a schematic showing an ink droplet exit orifice in the FIG. 1 structure and an elastomeric wiper blade commonly used for cleaning the orifice plate;

FIG. 3 the ink droplet as it begins to form in the orifice of FIG. 1;

FIG. 4 shows the ink droplet after formation with the orifice of FIG. 1;

DETAILED DESCRIPTION OF THE INVENTION

Figure 5:
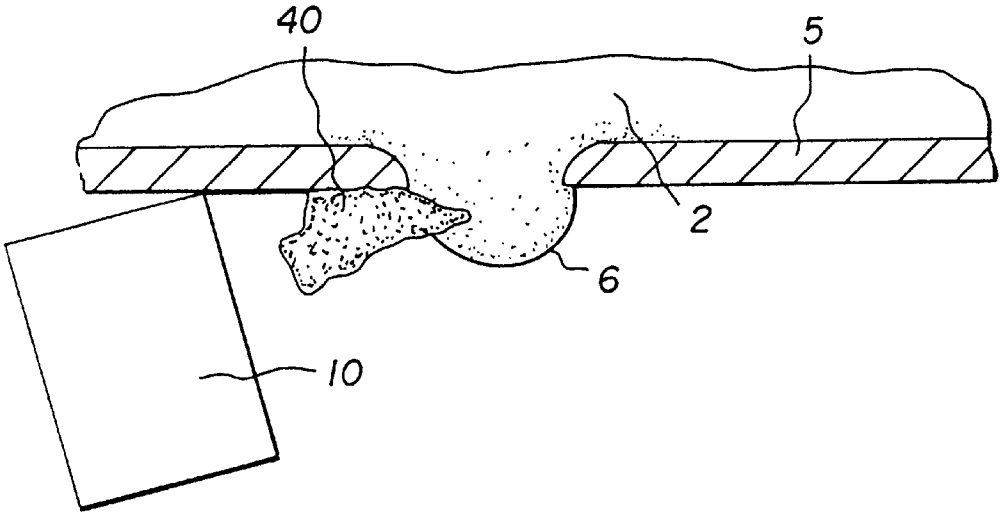
FIG. 5 shows the interference of the particulate debris with the formation of an ink droplet.

FIG. 1 shows a prior art cross sectional view of an inkjet print head 1. Orifices defining structures such as the depicted outlet plate 5 includes orifice 9 having a diameter "d" and can be manufactured by electro-forming or sheet metal fabrication methods. It will be understood that the outlet plate 5 actually includes a plurality of orifices for forming multiple ink droplets. The outlet plate 5 is glued to the piezo walls 3. Ink 2 is included in a pumping cavity 8. An inlet orifice 7 formed in a inlet plate 4 permits ink to be delivered to the pumping cavity 8. A meniscus 6 of ink is formed in the orifice 9.

FIG. 2 shows the outlet plate 5 with the ink outlet meniscus 6 and a elastomeric wiper blade 10 in contact with the outlet orifice plate. The blade is in position to wipe across the diameter "d" of the orifice 9 to clean any ink or other particulate debris that could interfere with the proper functioning of the inkjet print head 1.

FIG. 3 shows the meniscus 6 as it changes from an inward curve to an outward curve during the early stages before an actual ink droplet is manufactured. For reference and clarity the elastomeric wiper blade 10 and the outlet orifice plate 5 are also shown.

FIG. 4 shows the completed ink droplet 30, and its droplet direction is indicated by the arrow "X". Also shown are (as often is the case when an ink droplet is formed) two ink droplet satellites 31. The formation of satellites 31 is chaotic and can incorporate any number of ink droplet satellites 31 from 0 up to 10. These numbers of satellites 31 have been observed. Note that the outlet meniscus 6 has returned to the original state.

FIG. 5 shows how debris 40 can interfere with the meniscus 6 during the ink droplet formation. As the ink 2 touches the debris 40, the droplet formation can be completely stopped by the ink surface condition change, due to the presence of the debris 40. Again outlet orifice plate 5 and elastomeric wiper blade 10 are shown for clarity.

Figure 6:
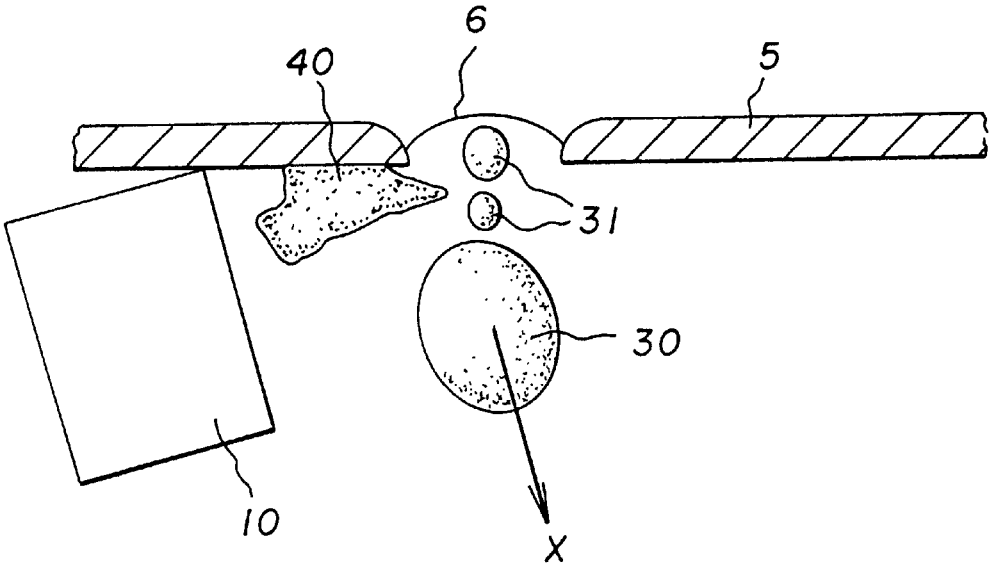
FIG. 6 shows that a particulate material can cause a change of direction of ink droplets.

FIG. 6 shows another defect caused by the presence of a debris 40. The direction of the droplet 30 with satellites 31 shown as "X" is changed and will result in a degradation of the image. Again outlet orifice plate 5 and elastomeric wiper blade 10 are shown for clarity. Note that the outlet meniscus 6 has returned to the original state but debris 40 can also interfere with that process.

Figure 7:
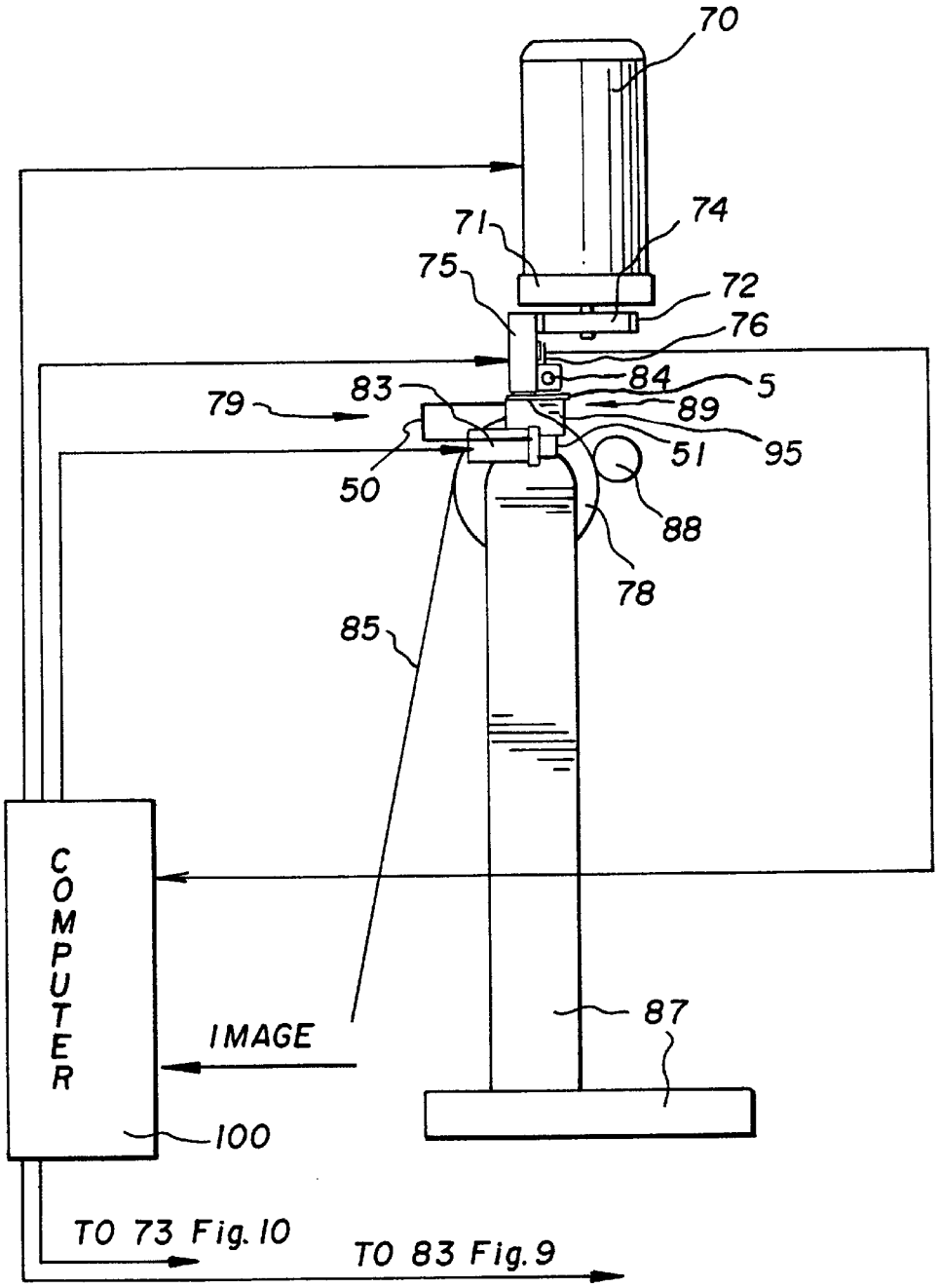
FIG. 7 shows a schematic of inkjet printing apparatus in accordance with the present invention which shows a print head and a cleaning station.

FIG. 7 shows an inkjet printing apparatus 79 in accordance with the present invention, an inkjet head 75, a drive motor 70 linked with a gearbox 71, an inkjet head belt drive wheel 74, and the inkjet head drive belt 72 to drive the inkjet head 75 back and for across the print paper 85. The inkjet droplets are controlled by the position of the inkjet head 75. This position is monitored by a position encoder strip 76 and the image input from computer 100. The same computer controls the inkjet print head 75, drive motor 70, the cleaning liquid 95, and the cleaning liquid pump 83. The cleaning liquid pump 83 pumps the cleaning liquid at a desired velocity towards the adjustable vane so that the vane creates a flow of cleaning liquid 95 past the outlet orifice plate 5. Also shown are the guide 84 for straight line back and forth motion of the inkjet head 75. The inkjet generates an image 81 (shown in FIG. 8) on the print paper 85. The print paper 85 is supported by the platen roller 78 and registration of the paper is controlled by the capstan roller 88. Both rollers, platen 78 and capstan 88 are driven by a motor not shown and are controlled by the computer 100. Also shown is a cleaning station 89 which receives cleaning liquid 95. The cleaning station 89 has liquid pump 83 with inlet and outlet connections 50 and 51 to the cleaning liquid pump 83. A mounting structure 87 supports all the associated mechanism for the inkjet printer 79.

Figure 8:
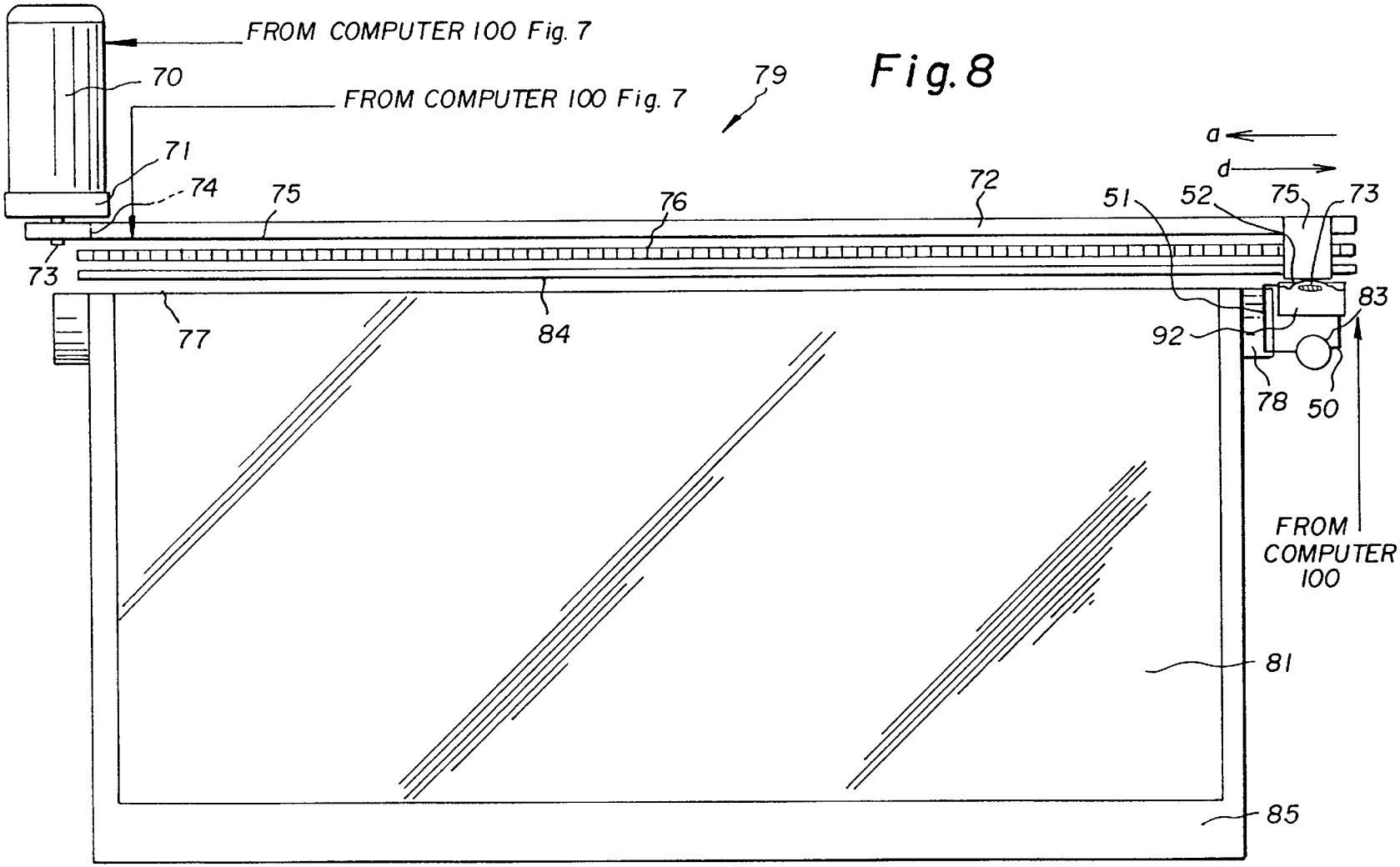
FIG. 8 shows the same as FIG. 7 but a different perspective for clarification of illustration.

FIG. 8 shows the same printer as FIG. 7 but in a 90 degree rotated position. It can now be visualized how the inkjet head 75 with ink droplets 77 move across the paper 85 driven by the inkjet print head drive motor 70, a gearbox 71 to match motor speed with print speed. An inkjet head drive belt 72 driven by the belt drive wheel 74 drives the inkjet print head 75 across the total width of the print paper 85. The position of the print head 75 is metered by the position encoder strip 76. At the right location determined by the computer 100 (shown in FIG. 7) and the encoder strip 76 a ink droplet 77 is deposited to form the image 81. When the inkjet print head 75 reaches the far end of the print paper 85 it decelerates in the indicated direction and distance of arrow "d". When reversing' indicated by the direction and distance of arrow "a", the print head 75 re-accelerates to the correct print speed. This turn around deceleration ("d") and re- ("a") time is used to accomplish the cleaning without added time for the inkjet print head 75. The cleaning station 89 is mounted at the far right side end of the inkjet printer 79. The cleaning station 89 has a cleaning fluid tank 92, a cleaning liquid pump 83, with inlet connection 50 and an outlet connection 51. The adjustable vane 73 deflects the cleaning liquid 95 into a wave 52 is as shown. This wave 52 is used to clean the orifice plate 5. A number of different cleaning liquids can be used in accordance with the present invention. For example, such fluids can include plain water, distilled water, and alcohol or detergent mixtures. See also the disclosure of the above referenced commonly assigned assigned U.S. patent application Ser. No. 09/159,447 filed concurrently herewith entitled "Cleaning Orifices in Inkjet Printing Apparatus" to Werner Fassler et al, the disclosure of which is incorporated herein by reference.

Figure 9:
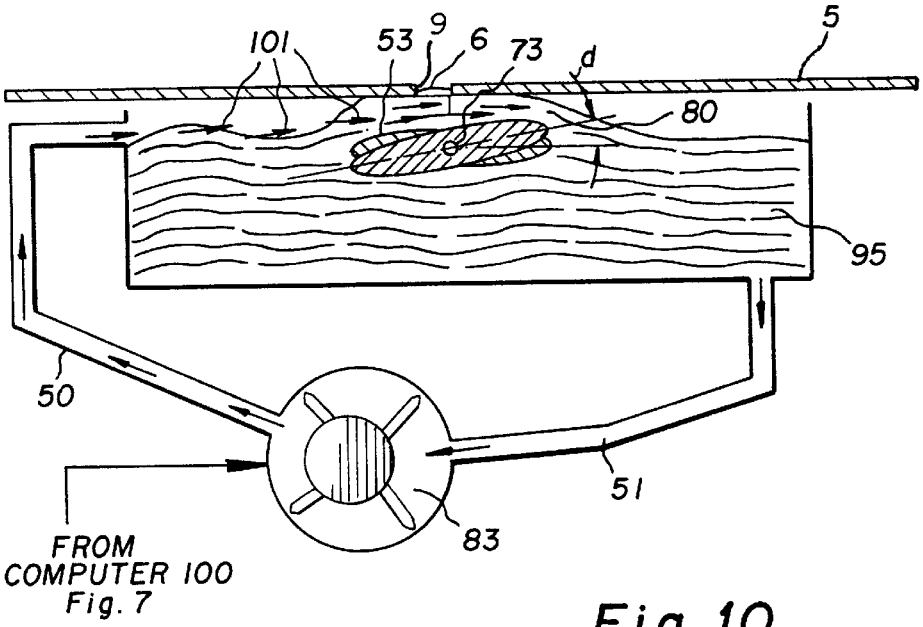
FIG. 9 shows the cleaning mechanism in accordance with the present invention.

FIG. 9 shows the cleaning liquid pump 83 with adjustable vane 73 mounted to a shaft 93 to rotate the adjustable vane 73. The vane is submerged in the cleaning liquid 95 and spaced from the outlet plate defining the orifices 9. The cleaning liquid 95 is pumped to flow across the adjustable vane 73, and occupies the cavity space 80 between the adjustable vane 73 and the outlet plate 5 so that a high enough fluid velocity is created to clean the orifices 9 and the outlet plate 5 from all debris 40. The adjustable vane 73 or the adjustable vane surface 53 is made from a material which conducive to laminar or turbulent flow of the cleaning liquid 95 through the cavity space 80. This adjustable vane 73 or vane surface material 53 can be selected from the group of materials consisting of aluminum, teflon, polyvinyl chlorine, stainless steel, glass, ceramic, and titanium. The friction of the cleaning liquid 95 on the on the outlet orifice plate 5 will cause a great amount of liquid shearing to remove dirt and ink from the outlet orifice plate 5. Arrows 101 indicates one of the possible two flow directions of the cleaning fluid.

Figure 10:
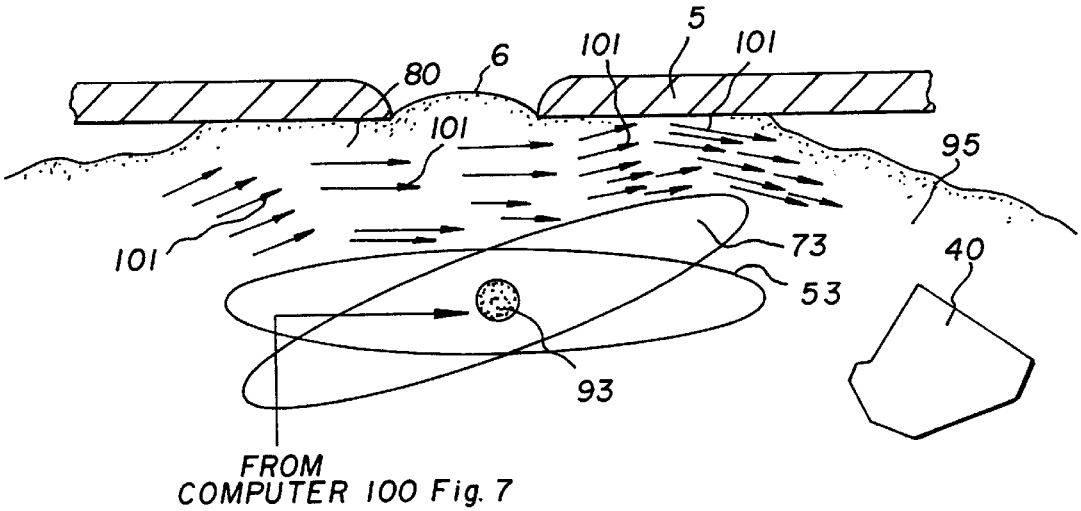
FIG. 10 shows an enlargement of the cleaning liquid flowing across the adjustable vane surface.

FIG. 10 shows in an enlarged form how the fluid friction shown by arrows 101 causes the flow of the cleaning liquid pump 83 to shear dirt and other debris 40 permanently from the outlet orifice plate 5. The arrows 101 indicate a laminar flow of fluid in the cleaning cavity space 80 but if desired a turbulent flow can be incorporated to enhance cleaning as desired. The adjustable vane 73 can be adjusted to squeeze the cavity dimension which will increases the flow at either end of the adjustable vane 73 to further help the cleaning effort. Also it is understood that the adjustable vane 73 can have many possible geometric shapes to facilitate the desired effects. Possible shapes are: cylinders, plates, foils, wedges, and ellipsoids. When the outlet plate 5 of the inkjet print head 75 ( see FIG. 8) moves across the cavity space 80 all parts of the outlet plate are exposed to low pressure and a high pressure caused by the angle of the adjustable vane. By positioning the adjustable vane 73, a laminar flow of cleaning liquid can be provided between the plate 5 and the surface of the vane. When in its counterclockwise position (angle "d" see FIG. 9), the flow rate is increased, creating a low pressure side as shown by the high concentration of arrows 101. A high pressure side is shown by the low concentration of arrows 101.

The invention has been described in detail, with particular reference to certain preferred embodiments thereof, but it should be understood that variations and modifications can be effected with the spirit and scope of the invention.

PARTS LIST

1 inkjet print head
2 ink
3 piezo material
4 inlet plate
5 outlet plate
6 outlet meniscus
7 inlet orifice
8 pumping cavity
9 outlet orifice
10 elastomeric wiper blade
30 ink droplet
31 satellite
40 debris as particles
50 inlet connection
51 outlet connection
52 cleaning fluid wave
53 adjustable vane surface
70 inkjet head drive motor
71 gearbox
72 inkjet head drive belt
73 adjustable vane
74 drive wheel
75 inkjet head
76 encoder strip
77 ink droplets
78 platen roller
79 inkjet printer
80 cavity space
81 image
83 cleaning liquid pump
84 guide
85 print paper
87 mounting structure
88 capstan roller
89 cleaning station
92 cleaning fluid tank
93 shaft
95 cleaning liquid
100 computer
101 arrows

What is claimed is:

1. An inkjet printer having an inkjet head and defining a structure defining a plurality of orifices for ejecting ink droplets, comprising:

a) means defining an ink cleaning cavity spaced-apart from a printing position for receiving cleaning fluid;

b) an adjustable vane submerged to a predetermined depth in the cleaning fluid and spaced-apart from the structure, the vane defining a surface thereon;

c) pumping means for delivering the cleaning liquid at a predetermined velocity towards the adjustable vane, the vane creating a flow of cleaning liquid past the structure in the cleaning cavity space; and d) means for positioning the vane to create a desired flow of cleaning liquid which engages the structure, wherein the vane is positioned so as to produce a high pressure side and a low pressure side with respect to the cleaning cavity space, wherein the vane surface is made from a material which is wetable by the cleaning liquid to enhance lamina flow of the cleaning liquid in the cleaning cavity space, and whereby the orifices are cleaned by the cleaning liquid while lamina flow of the cleaning liquid in the cleaning cavity is enhanced.

* * * * *